US006424090B1

(12) United States Patent
Sklyarevich

(10) Patent No.: US 6,424,090 B1
(45) Date of Patent: Jul. 23, 2002

(54) MODIFICATION OF MILLIMETRIC WAVELENGTH MICROWAVE BEAM POWER DISTRIBUTION

(75) Inventor: Vladislav Sklyarevich, Feasterville, PA (US)

(73) Assignee: GTI, Bristol, PA (US)

( * ) Notice: Subject to any disclaimer, the term of this patent is extended or adjusted under 35 U.S.C. 154(b) by 0 days.

(21) Appl. No.: 09/439,533

(22) Filed: Nov. 12, 1999

(51) Int. Cl.[7] ..... H01J 25/00

(52) U.S. Cl. ..... 315/5; 315/4; 359/883; 343/915

(58) Field of Search ..... 315/5, 4, 39; 359/883, 359/884, 589; 343/915

(56) References Cited

U.S. PATENT DOCUMENTS 4,636,688 A 1/1987 Ito ..... 315/4
4,839,561 A 6/1989 Ito ..... 315/4
5,115,482 A 5/1992 Stallard et al. ..... 385/28
5,138,230 A * 8/1992 Jodicke et al. ..... 315/5
5,162,811 A * 11/1992 Lammers et al. ..... 343/915
5,307,080 A * 4/1994 Okumura ..... 343/915
5,440,320 A * 8/1995 Lach et al. ..... 343/915
5,610,482 A * 3/1997 Dumbrajs et al. ..... 315/500
5,719,470 A * 2/1998 Hirata et al. ..... 315/5
5,780,969 A * 7/1998 Sakamoto et al. ..... 315/5

* cited by examiner

*Primary Examiner*—Don Wong
*Assistant Examiner*—Ephrem Alemu
(74) *Attorney, Agent, or Firm*—Rothwell, Figg, Ernst & Manbeck

(57) ABSTRACT

A system and method for increasing the power density distribution uniformity of a gyrotron radiation beam provides a mirror for reflecting the gyrotron beam onto an object to be irradiated, where the shape of the mirror surface is changed by a plurality of controllable and movable mirror support members in a chaotic or random manner during generation of the gyrotron beam on the mirror surface, and the shape of the mirror surface is changed at a predetermined frequency F according to a predefined algorithm.

4 Claims, 4 Drawing Sheets

Beam track over object surface
f = 0 KHz

Beam track over object surface
f = 1 KHz

Beam track over object surface
f = 100 KHz

MODIFICATION OF MILLIMETRIC WAVELENGTH MICROWAVE BEAM POWER DISTRIBUTION

BACKGROUND OF THE INVENTION

1. Field of the Invention

This invention relates generally to microwave devices for generating electromagnetic waves in the shape of a beam, and more particularly to optical systems for transmitting free-space gyrotron radiation output mode beams with improved spatial power distribution.

2. Description of Background Art

Many materials manufacturing processes such as drying, sintering, annealing, curing, coating, joining and melting of materials such as ceramics, semiconductors and other non metallic materials require the application of precise and uniform amounts of heat. Microwave radiation systems have been developed for drying and sintering materials through the coupling of microwave radiation to heat such materials. For such processes the microwave radiation is not used as a beam and the necessary power distribution is created by the cavities.

While such microwave generation systems offer new methods of materials processing, their application often is limited by the achievable degree of coupling of the microwave energy to the materials to be processed.

Recently, powerful CW (continuous wave) millimeter wavelength generators have become available, with the most promising of such generators being the gyrotron, which generates an electromagnetic beam with a wavelength from one to 10 mm and at intensities of more than 100 KW/cm$^2$. Conventionally, gyrotron devices have been used in nuclear fusion reactors for plasma heating applications. See, e.g., U.S. Pat. Nos. 4,636,688, 5,115,482, 4,839,561.

Millimetric wavelength microwave beams (MWMB) possess properties not held by conventional microwave generation systems nor by any other known source of radiant energy. In particular, radiation of such wavelengths and power density ensures extremely fast volumetric heating of nonmetallic materials of thicknesses from several millimeters to several centimeters. It is possible using such beams for the heating to occur in such a short time period that any desired region or layer within an exposed material can be heated to any required temperature, while leaving the surrounding regions either completely unheated, or at differing selected temperatures. Such material thickness range coincidentally corresponds to the geometrical sizes of components that are treated by the majority of materials manufacturing processes such as deposition of coatings, powder treatment, soldering, etc. These special properties of MWMB potentially enable new methods for materials processing to be devised.

As opposed to electromagnetic waves in the millimetric wavelength range, centimeter or meter length waves exhibit an excessive penetration depth, ranging up to dozens of centimeters and even meters. Additionally, it is very difficult using such waves to provide fast local heating to high temperatures. At the other end of the spectrum, the shorter wavelength sources of electromagnetic radiation, such as laser, infrared and similar sources, exhibit too small a depth of penetration, and similar to plasma heating, electron radiation heating or convection heating, heat the exposed material from the surface.

MWMBs produced, for example, by gyrotron radiation can be directed using a simple metal mirror and can take any form. In most applications a MWMB of square or circular shape and from 10 to 100 cm$^2$ is necessary. Additionally, in many applications, especially where fast local heating of materials is required, it is necessary to ensure uniform heating over the entire surface covered by the heat spot. Usually, this uniformity must be better than 10%, requiring that the uniformity of the power distribution of the gyrotron beam be equally high.

Unfortunately, the spatial power distribution in a millimetric wavelength microwave beam, including a Gyrotron beam, are very non-uniform. While commercial generator (i.e., gyrotron, klystron, etc.) manufacturers will specify that the beam has a gaussian distribution, this is true only for a specific operational mode, at a specific output power, and with an ideally matched load. For most industrial application purposes the output power (i.e., current and voltage) of the generators must be modified, and this leads to a significant modification of the distribution of the beam power density, and even to a modification of the distribution function of the beam power density itself. The beam power distribution is no longer gaussian or elliptical, but becomes asymmetrical and acquires additional maxima and minima (which are usually spread in non-parallel directions).

Further, it is usually impossible to achieve full compliance or matching of the generator with the load (e.g., the processed material, the walls of a work chamber, etc.), thereby degrading the distribution even further from the idealized gaussian distribution curve. Finally, the power distribution also is affected by reflected beams, the effects of which are extremely difficult to calculate, making it very difficult to run any theoretical analysis of real power distribution in an actual beam. At the same time, however, such an analysis is essential for any specific application of the MWMB to be implemented.

Neither is it feasible to design a mirror to achieve the necessary uniformity of a MWMB over an irradiated object, because many different intensities and size spots in random locations exist within the MWMB. The use of electrodynamic devices to improve uniformity results in the loss of a significant amount of power (over 60 to 80%) in addition to losing the beam shape.

It may appear that a more efficient method for uniform object irradiation would be to scan the MWMB over an object to be irradiated using a simple mirror. However, this method would be feasible only where 1) the object is movable, and moves perpendicularly to the direction of beam scanning; and 2) the processing materials allow for heating on a part-by-part basis. Experience has shown that for most applications, such as processing of semiconductors, ceramics, mass soldering, paste burn-in, curing of polymers and many other technological processes, these conditions cannot be met.

For such processes, it also may appear that necessary uniformity might be achieved by two-dimensional scanning. However, the MWMB is not a point source like the electron beam in a television picture tube, and therefore any periodic scanning in two coordinates would produce the appearance of non-uniformity strips.

There thus exists a need in the art to achieve a necessary MWMB power distribution uniformity for material processing and other applications to take advantage of the many benefits available with the use of a MWMB for such processes.

SUMMARY OF THE INVENTION

The present invention provides a solution to the problems existing in the prior art, by providing a system and method for achieving power density uniformity of a MWMB. According to the invention, uniformity is achieved by reflecting a MWMB in a chaotic or random manner as it is being applied to an object to be irradiated. According to one preferred embodiment of the invention, this is accomplished by providing a mirror having a variable surface shape for reflecting the beam onto an object. The shape of the mirror is changed in a random or chaotic manner by drive mechanisms that are controlled at a predetermined frequency according to the degree of uniformity required and the time interval within which the uniformity must be achieved.

BRIEF DESCRIPTION OF THE DRAWINGS

The present invention can be more fully understood from the detailed description given below in conjunction with the accompanying drawings. These are provided by way of illustration only and are not intended as limiting the present invention, and wherein.

DETAILED DESCRIPTION OF THE PREFERRED EMBODIMENTS

Figure 1A:
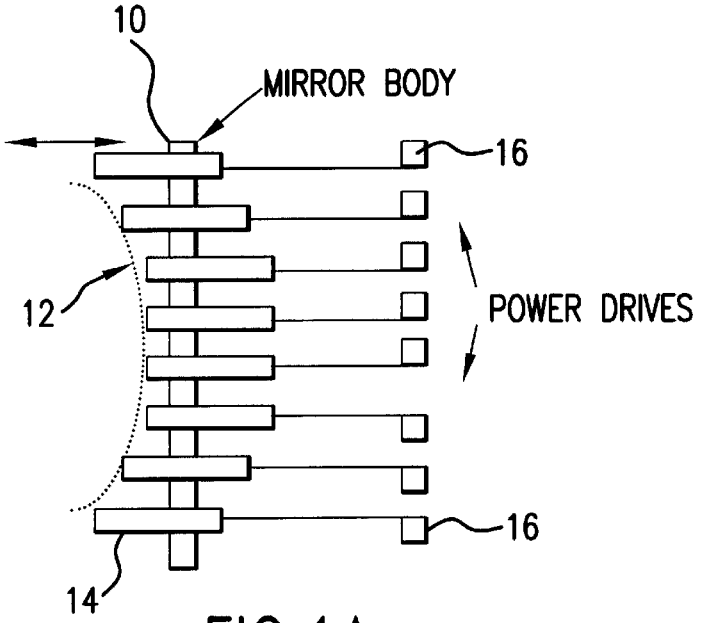
FIG. 1A is a diagram of a MWMB variable-surface mirror system according to one embodiment of the present invention, wherein the MWMB is produced by a gyrotron.
Figure 1B:
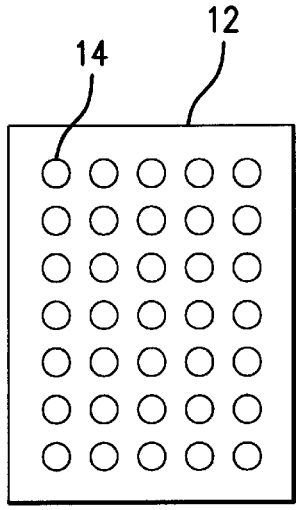
FIG. 1B is a front view of the variable-surface mirror of FIG. 1A.
Figure 2:
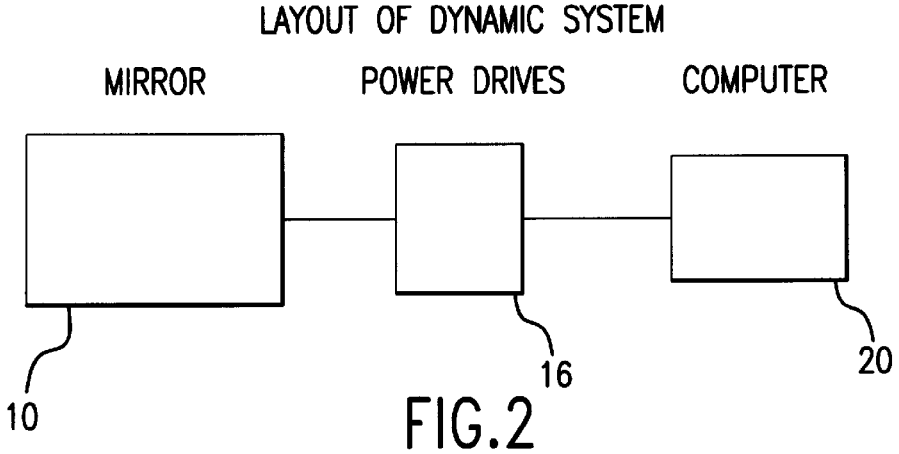
FIG. 2 is a block diagram of a control system according to one embodiment of the invention.

Referring to FIGS. 1A–1B, a variable-surface mirror 10 is provided for reflecting a MWMB (gyrotron beam) onto an object to be irradiated. Mirror 10 has a mirror surface 12 having a shape that is variable according to the position of surface support members 14. Members 14 are driven by power drives 16, which may be implemented by step motors or like drive devices, which may be driven at relatively high frequencies. According to the invention, the drives 16 are individually driven in a random, pseudorandom, or chaotic manner, such as according to a specific random or chaotic drive algorithm programmed into a computer control such as computer 20 as shown in FIG. 2. Directing a gyrotron beam onto the surface of the mirror 10 while the surface shape is being randomly varied will achieve a uniform power density distribution by effectively "stirring" the gyrotron beam. For increased focusing of the uniform beam, a second cylindrical or spherical mirror as well as lenses can be used.

What remains is the determination of the frequency of the movement or change in the shape of the mirror surface that is needed to achieve a required degree of uniformity of the MWMB (Gyrotron beam). Here, the term TTU or technological time unit is used to define a time interval within which a particular part or region of an object must be heated to a desired temperature to avoid undesirable effects of non-uniform heating. For example, for burn-in of glass-metal pastes into ceramic substrates, this time is 1.2 to 1.5 sec.; for processing of semiconductors, this time is 2 to 3 sec.

To calculate the requisite frequency of random mirror surface movement, it is assumed that the distribution of power in the beam falling on an object surface S has the form of an arbitrary function F(x,y), and that the area of the beam spot is $S_0$.

$S_0$ so is then broken down into M areas of the same size, within the limits of which the value of F(x,y) can be considered constant and equal to $F_i$ for the i-th beam area. The probability P of one "hit" onto some particular area of an object surface by the i-th beam element then will be given by:

$$P=(1/M)(S/S_0) \tag{1}$$

If the beam falls onto an object surface N times, the probability of the i-th beam element occurring $a_i$ times against the object surface will be given by:

$$P(F_i,a_i)=C^{ai}{}_N p^{ai}(1-p)^{N-ai} \tag{2}$$

where $C^{ai}{}_N$ is the number of combinations. The total radiation intensity falling on the surface area N times will be given by:

$$I=\sum_{i=1}^{M} F_i a_i \tag{3}$$

The I value distribution follows the law similar to equation (2), which in the case of high N is the normal distribution. Adding parameter J, which is the relative deviation of I from its mean value $I_m$, will yield:

$$J=(I-I_m)/I_m=\Delta I/I_m \tag{4}$$

Using the properties of the normal distribution we can determine that the probability of J not exceeding $J_0$, which determines the permissible amount of nonuniformity, will be:

$$P(J<J_0)=2\Big/\sqrt{(2\pi)}\int_0^z \exp(-t^2/2)\,dt \tag{5}$$

$$\text{where } z=J_0\sqrt{S_0N/Sk},\ k=\langle F^2\rangle/\langle F\rangle^2 \tag{6}$$

The value of k depends upon an initial nonuniformity of the power density distribution in the incident gyrotron radiation beam. For example, for a uniform beam, k=1. If the function has the form $F=A\exp(-r^2/R^2)$ and is set in a beam spot of radius R, it is not difficult to show that k≈1.1. For a more complex function, e.g., $$F(\bar{r})=\sum_{i=1}^{3} A_i\exp\{-(\bar{r}-\bar{r}_i)^2/R_i^2 \tag{7}$$

(approaching the power distribution observed in a real gyrotron beam) k≈1.2, i.e., it is also close to 1.

It is known from the properties of (5) that $P(J<J_0)\sim 1$ (the deviation of radiation intensity close to 100% probability does not exceed $J_0$) if z>2.5.

Figure 3:
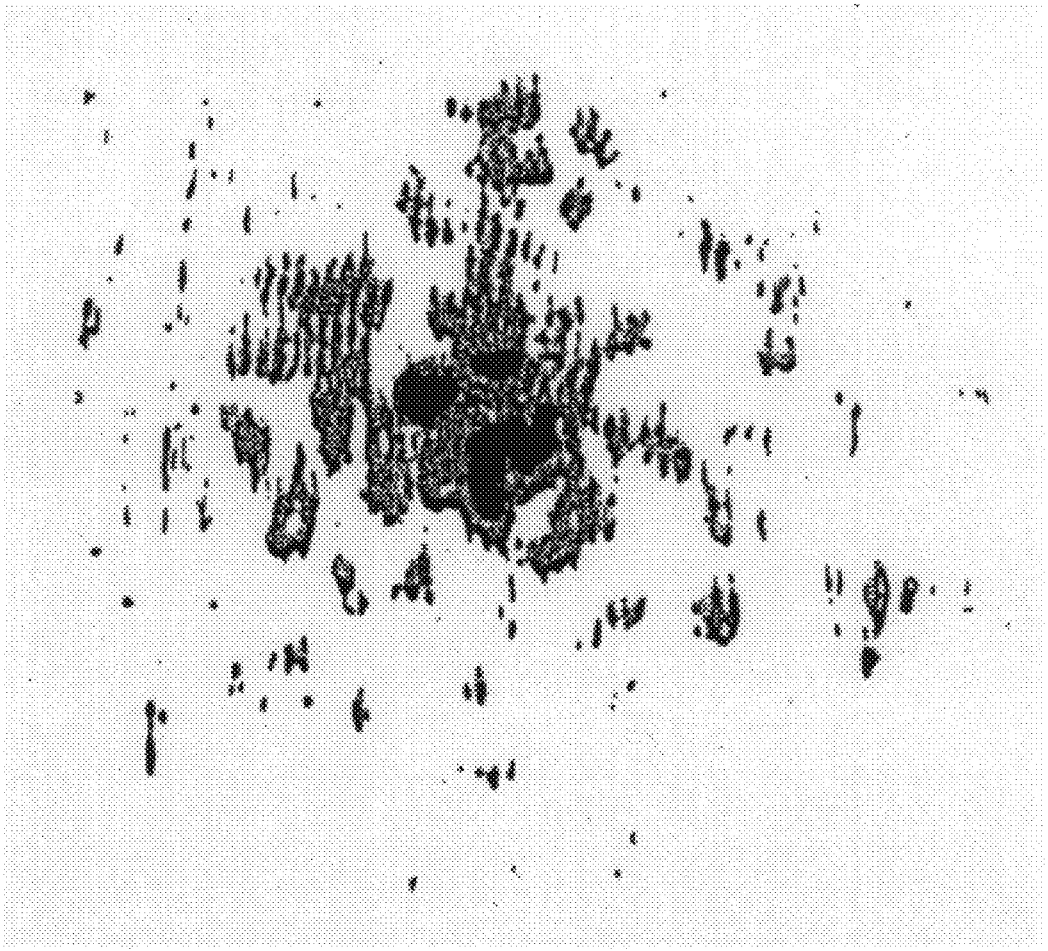
FIGS. 3–5 are beam track images showing the patterns of various MWMB (gyrotron beam) movements at different frequencies, according to the invention.
Figure 4:
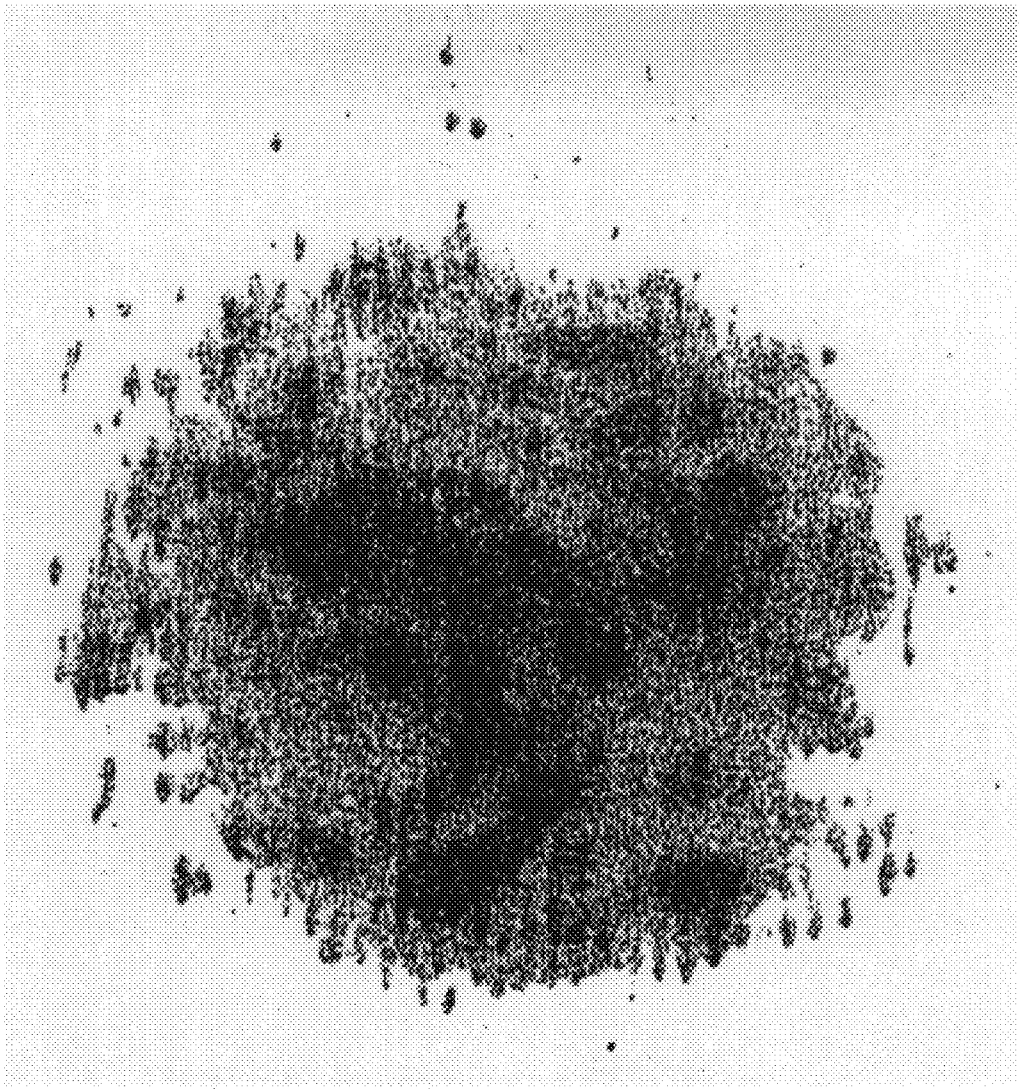
Figure 5:
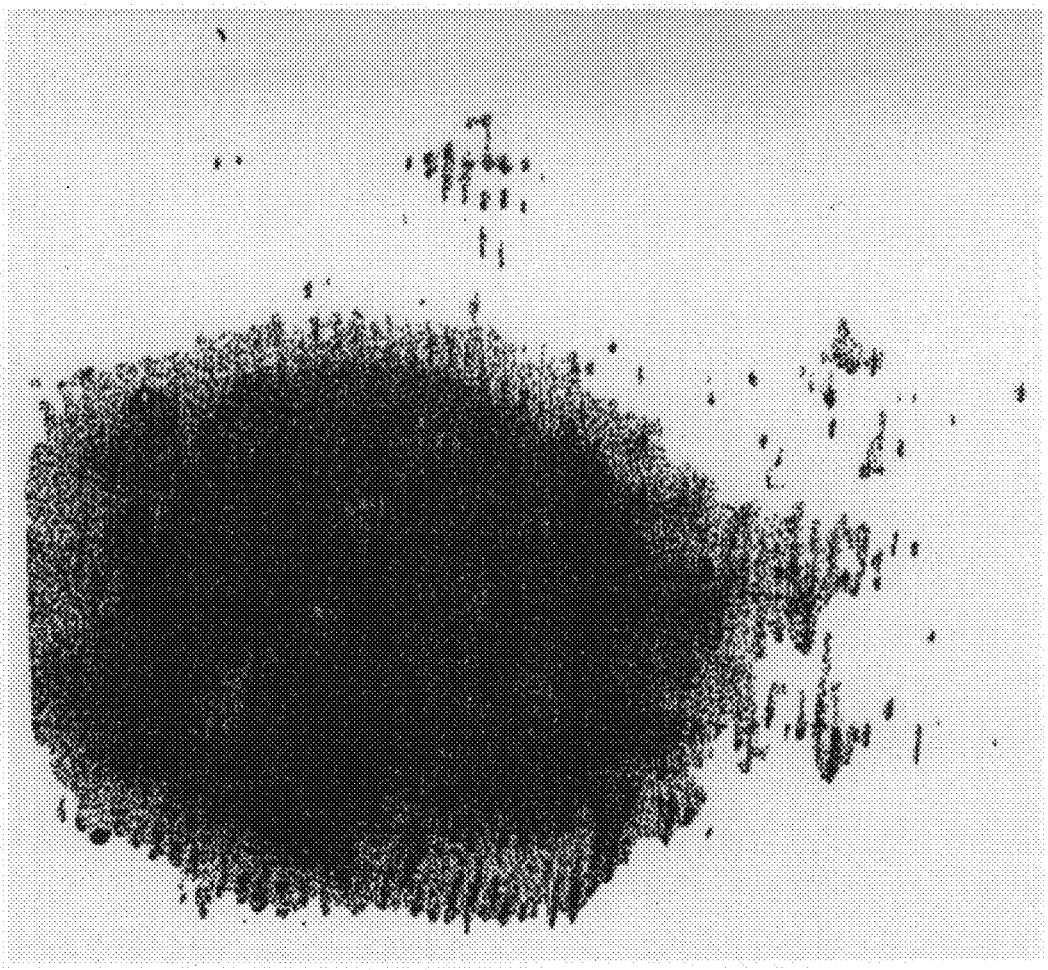

Thus, the following expression fairly indicates the frequency of chaotic beam movement over the object surface:

$$F=6\ S/(S_0tJ_0^2)(\text{Hz}) \tag{8}$$

where:

S=object surface area $S_0$=beam spot area t=time (sec) of achieving required uniformity $J_0$ Thus, when processing a workpiece having a surface area S of 10 $cm^2$, $S_0$=2 $cm^2$, to have power density nonuniformity of less than 10% it is necessary to "stir" the incident beam at a frequency of not less than 2.5 kHz in 1.5 sec. To provide a nonuniformity of less than 5%, the frequency will be 8 kHz, and for a nonuniformity of 1%, the frequency will be 200 kHz. FIGS. 3–5 show beam tracks for gyrotron beam "stirring" at frequencies of 0 kHz, 1 kHz, and 100 kHz, respectively.

The invention having been thus described, it will be apparent to those skilled in the art that the same may be varied in many ways without departing from the spirit and scope of the invention. Accordingly, any and all such modifications are intended to be covered by the following claims.

What is claimed is:

1. A system for increasing the power density distribution uniformity of a millimetric wavelength microwave beam, comprising:

a mirror for reflecting the millimetric wavelength microwave beam onto an object to be irradiated, said mirror having a variable surface shape, said surface shape being controlled by a plurality of movable mirror support members;

a plurality of power drive devices for moving said plurality of mirror support members; and a control device for controlling the number of said power drive devices being operated at any one time, such that the shape of said mirror changes in a chaotic or random manner during generation of said beam on said mirror surface for radiation of said object, and the shape of said mirror surface is changed at a predetermined frequency F, wherein said frequency F is determined according to the equation $F=6\ S/S_0tJ_0^2$ (Hz) where: S=object surface area, $S_0$=beam spot area, and t=time (sec) of achieving required uniformity $J_0$.

2. A system as set forth in claim 1, wherein said beam is a gyrotron beam.

3. A method for achieving uniform power density distribution of a millimetric wavelength microwave beam, comprising the steps of:

providing a mirror for reflecting the millimetric wavelength microwave beam onto an object to be irradiated, said mirror having a variable surface shape, said surface shape being controlled by a plurality of movable mirror support members; and controlling the changing of the shape of said mirror in a chaotic or random manner during generation of said beam on said mirror surface for radiation of said object, and changing the shape of said mirror surface at a predetermined frequency F, wherein said frequency F is determined according to the equation $F=6\ S/S_0tJ_0^2$ (Hz) where: S=object surface area, $S_0$=beam spot area, and t=time (sec) of achieving required uniformity $J_0$.

4. The method of claim 3, wherein said beam is a gyrotron beam.

* * * * *